US006006819A

United States Patent [19]

Shimizu et al.

[11] Patent Number: 6,006,819

[45] Date of Patent: Dec. 28, 1999

[54] PROCESS FOR PRODUCING ALUMINUM-BASED COMPOSITE MEMBER

[75] Inventors: Hideo Shimizu; Tsunehisa Hata; Yusuke Toyoda; Takeo Itou; Norito Suzuki; Katuya Nagase, all of Saitama, Japan

[73] Assignee: Honda Giken Kogyo Kabushiki Kaisha, Tokyo, Japan

[21] Appl. No.: 09/044,517

[22] Filed: Mar. 19, 1998

[30] Foreign Application Priority Data

Mar. 19, 1997 [JP] Japan ..... 9-085969

[51] Int. Cl.[6] ..... B22D 19/04; B22D 19/16

[52] U.S. Cl. ..... 164/100; 164/101; 164/103

[58] Field of Search ..... 164/100, 101, 164/103; 427/305, 380

[56] References Cited

FOREIGN PATENT DOCUMENTS 1808843 8/1969 Germany ..... 164/100
54-28225 3/1979 Japan ..... 164/100
2006342 1/1994 Russian Federation ..... 164/100

*Primary Examiner*—Kuang Y. Lin
*Attorney, Agent, or Firm*—Lyon & Lyon LLP

[57] ABSTRACT

An aluminum-based composite member having an increased strength of bond between an aluminum-based body and a cast iron material portion which is incorporated into the aluminum-based body by casting is provided by an improved process. The following steps are employed in the process: a step of removing an oxide film on the surface of the cast iron material portion and activating such surface; a step of forming a protecting plated-layer having a thickness a in a range of 0.8 $\mu m \leqq a \leqq 5$ $\mu m$ on the surface of the cast iron material portion; a step of preheating the cast iron material portion in a reducing gas atmosphere and reducing an oxide on the surface of the protecting plated-layer; a step of vanishing the protecting plated-layer by a diffusing phenomenon and forming an aluminum-based alloy plated layer on the surface of the cast iron material portion by immersing the cast iron material portion into a molten aluminum-based alloy; a step of quenching the cast iron material portion in an inert gas atmosphere; and a step of incorporating the cast iron material portion into the aluminum-based body by casting.

12 Claims, 8 Drawing Sheets

PROCESS FOR PRODUCING ALUMINUM-BASED COMPOSITE MEMBER

The present invention relates to a process for producing an aluminum-based composite member, particularly, an aluminum-based composite member comprised of an aluminum-based body and a cast iron material portion incorporated into the aluminum-based body by casting.

A piston for a diesel engine is conventionally known as such a type of aluminum-based composite member. The piston is comprised of a piston body formed of an aluminum alloy, and an annular Ni-resist cast iron material portion incorporated into the piston body to form a first pressure ring groove. In producing such a piston, an aluminum-based alloy plated layer is formed on the surface of the Ni-resist cast iron material portion in order to increase the bond strength between the Ni-resist cast iron material portion and the piston body.

The aluminum-based alloy plated layer in such conventional device is formed by a molten aluminum-based alloy plating treatment. Prior to this molten aluminum-based alloy plating treatment, the surface of the Ni-resist cast iron material portion is subjected to pretreatments including the removal of an oxide film, degreasing, acid cleaning and the like, whereby the surface is cleaned and activated. In the prior art, however, no special surface-protecting measure is taken after the pretreatments. Therefore, if the Ni-resist cast iron material portion is preheated with the passage of time after the pretreatments and prior to the molten aluminum-based alloy plating treatment, the surface of the Ni-resist cast iron material portion is oxidized again, and as a result, the activated state of the surface is largely declined.

For this reason, the Ni-resist cast iron material portion must be kept immersed in the molten aluminum-based alloy for a relatively long period of time in the molten aluminum-based alloy plating treatment in order to form an aluminum-based alloy plated layer having a predetermined thickness. As a result, the following problems arise.

If the immersion time exceeds a certain time, the surface layer of the Ni-resist cast iron material portion is melted into the molten aluminum-based alloy, and the molten amount reaches 20 to 40 $\mu$m in terms of thickness of the surface layer. This melting causes flake-shaped graphite existing in the surface layer to protrude from a new surface of the Ni-resist cast iron material portion, and causes an intermetallic compound layer produced by a chemical reaction of the Ni-resist cast iron material and the molten aluminum-based alloy to be formed on the new surface. This intermetallic compound layer is hard and brittle and moreover, is subjected to a cutting-out effect due to the inclusion of the flake-shaped graphite penetrating the intermetallic compound layer. Due to this, the bond strength between the piston body and the Ni-resist cast iron material portion is lowered.

If the cooling rate for the Ni-resist cast iron material portion is lower after the molten aluminum-based alloy plating treatment, the growth of the intermetallic compound layer and the oxidation of the surface of the aluminum-based alloy plated layer are advanced. This also causes the lowering of the bond strength.

SUMMARY OF THE INVENTION

It is an object of the present invention to provide a process of the type described above, which is capable of producing an aluminum-based composite member having an increased bond strength between the aluminum-based body and the cast iron material portion, by substantially shortening the time of immersion of the cast iron material portion in the molten aluminum-based alloy plating treatment and accelerating the cooling of the cast iron material portion after the molten aluminum-based alloy plating treatment by employing a particular measure.

To achieve the above object, according to the present invention, there is provided a process for producing an aluminum-based composite member comprised of an aluminum-based body and a cast iron material portion incorporated into the aluminum-based body by casting, the process comprising a first step of removing an oxide film on the surface of the cast iron material portion and activating such surface, a second step of forming a protecting plated-layer having a thickness a in a range of $0.8\ \mu m \leqq a \leqq 5\ \mu m$ on the surface of the cast iron material portion, a third step of preheating the cast iron material portion in a reducing atmosphere and reducing an oxide on the surface of the protecting plated-layer, a fourth step of vanishing the protecting plated-layer by a diffusing phenomenon and forming an aluminum-based alloy plated layer on the surface of the cast iron material portion by immersing the cast iron material portion into a molten aluminum-based alloy, a fifth step of quenching the cast iron material portion in an atmosphere of one of an inert gas and a reducing gas, and a sixth step of incorporating the cast iron material portion into the aluminum-based body by casting.

In the above process, the surface of the cast iron material portion cleaned and activated at the first step is protected by the protecting plated-layer formed at the second step. In preheating the cast iron material portion prior to the molten aluminum-based alloy plating treatment at the fourth step, this preheating is carried out in a reducing atmosphere and hence, the surface of the protecting plated-layer can be activated.

In the molten aluminum-based alloy plating treatment at the fourth step, metal elements forming the protecting plated layer are diffused with a good efficiency into the molten aluminum-based alloy to vanish the protecting plated layer. This causes the cleaned and activated surface of the cast iron material portion to be exposed and hence, the aluminum-based alloy plated layer is formed on such surface. A series of these phenomena are performed quickly and hence, the time of immersion of the cast iron material portion into the molten aluminum-based alloy is substantially shortened. For example, the immersion time c is set in a range of $1\ \text{second} \leqq c \leqq 10$ seconds.

If the quenching is carried out in the inert gas or the reducing gas at fifth step, the advancing of the growth of the intermetallic compound layer produced between the cast iron material portion and the aluminum-based alloy plated layer and the oxidation of the surface of the aluminum-based alloy plated layer can be suppressed to the utmost.

The aluminum-based body and the cast iron material portion are bonded to each other through the aluminum-based alloy plated layer having the thin intermetallic compound layer and the cleaned surface at the sixth step. Therefore, the strength of bond between the aluminum-based body and the cast iron material portion is substantially increased.

If the thickness a of the protecting plated layer is smaller than 0.8 $\mu$m, the wettability between the protecting plated layer and the molten aluminum-based alloy is poor. On the other hand, if $a > 5\ \mu m$, the protecting plated layer is left on the surface of the cast iron material portion, and this remaining protecting plated layer causes the strength of bond between the aluminum-based body and the cast iron material portion to be lowered, as does the intermetallic compound layer. Therefore, the thickness a larger than 5 μm is not preferred, and is economically inconvenient.

DETAILED DESCRIPTION OF THE PREFERRED EMBODIMENTS OF THE INVENTION

Figure 1:
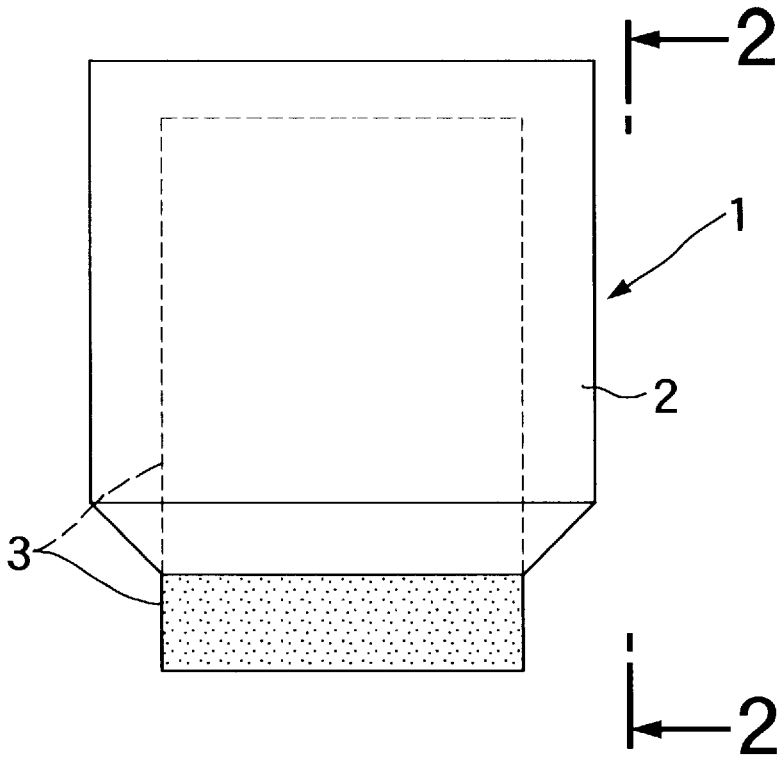
FIG. 1 is a front view of an aluminum-based composite member.
Figure 2:
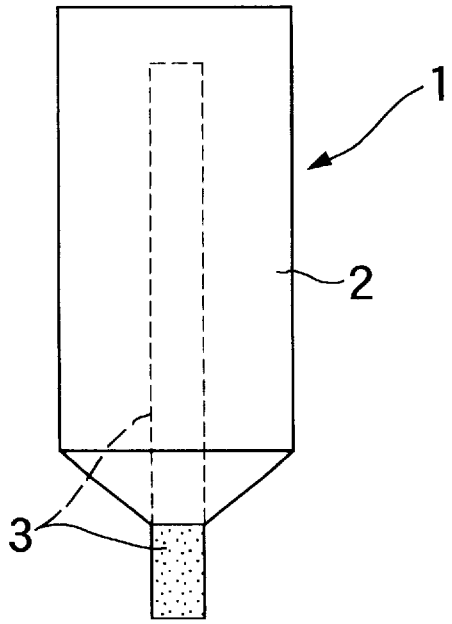
FIG. 2 is a view taken along a line 2—2 in FIG. 1.

Referring to FIGS. 1 and 2, an aluminum-based composite member 1 is comprised of a thick plate-shaped aluminum basic body 2, and a thin plate-like cast iron material portion 3 incorporated into the aluminum basic body 2 by casting. A portion of the cast iron material portion 3 protrudes from the aluminum-based body 2.

Such an aluminum-based composite member 1 is produced through the following steps.

1. First Step (a) Oxide Film Removing Treatment

The surface of the cast iron material portion 3 is subjected to a shot-blasting treatment using a grindstone as a shot, thereby removing an oxide film on the surface and increasing the surface area by the roughening of the surface.

(b) Degreasing Treatment

The cast iron material portion 3 is immersed into an organic solvent having a good permeability such as acetone for 2 to 48 hours, thereby completely removing fats and oils adsorbed on graphite or the like.

(c) Acid Cleaning Treatment

The cast iron material portion 3 is immersed into 20% hydrochloric acid for 1 to 3 minutes, thereby activating the surface of the cast iron material portion 3. When there is a smut such as iron chloride adhered to the surface of the cast iron material portion 3, the cast iron material portion 3 is placed into pure water for ultrasonic washing.

2. Second Step

The surface of the cast iron material portion 3 is subjected to an electroplating treatment, an electroless plating treatment or a gas-phase plating treatment (a vacuum vapor deposition or the like), thereby forming a protecting plated-layer having a thickness a in a range of 0.8 μm≦a≦5 μm. The protecting plated-layer is formed of a metal such as Ni, Cu or Fe, or an alloy including two of these metals, or an alloy comprised of one of the above-described metals and the above-described alloys and a metal such as P, B and the like which are diffusion-promoting elements. The protecting plated-layer may be of a laminated structure within the above-described range of thickness. These metals and alloys are selected, because they form oxides that are reduced by hydrogen gas. This is because a reducing gas at the next step includes hydrogen gas.

Figure 3:
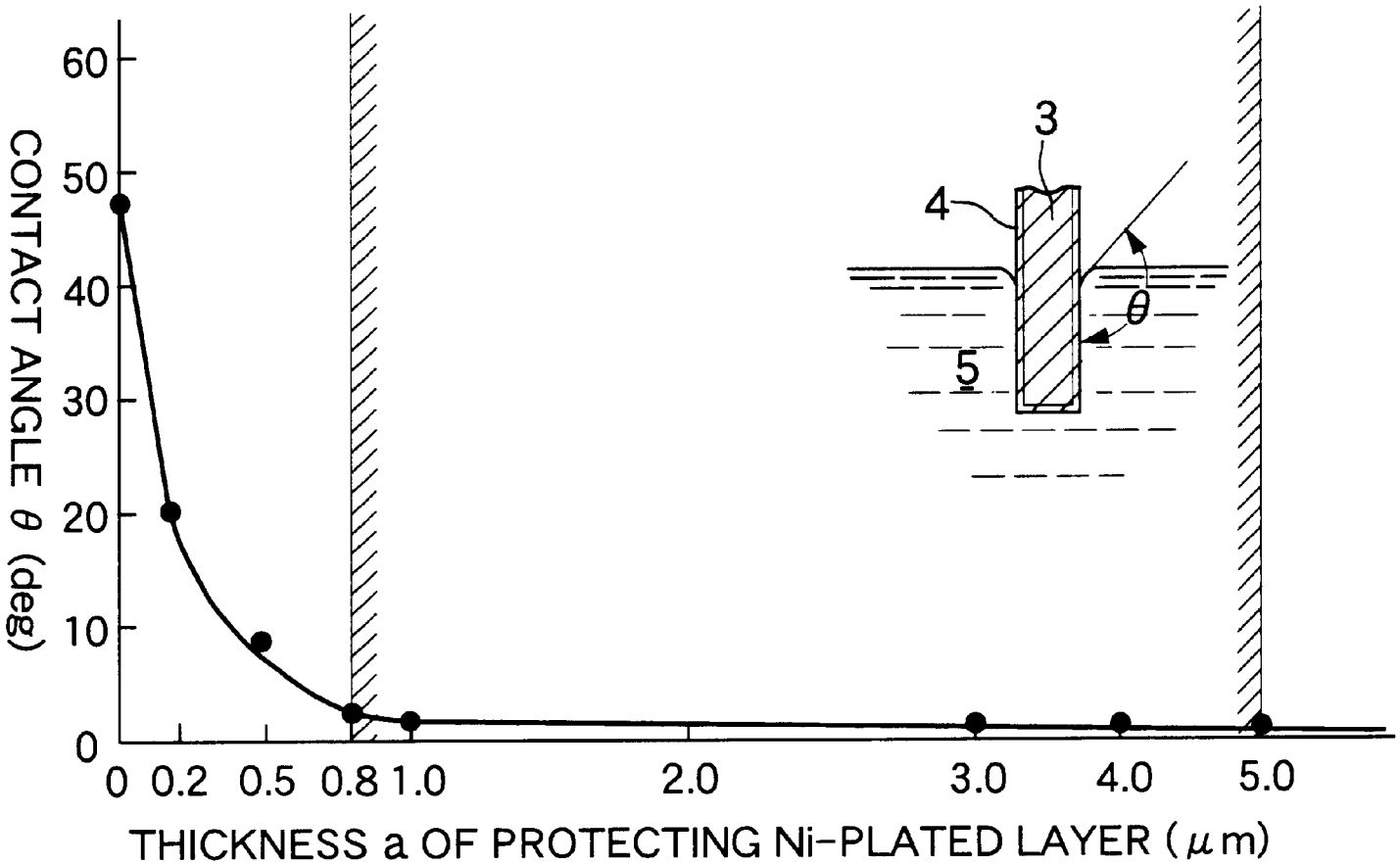
FIG. 3 is a graph showing the relationship between the thickness a of a protecting Ni-plated layer and the contact angle θ.

FIG. 3 shows the relationship between the thickness a of the protecting plated-layer made of nickel, i.e., a protecting Ni-plated layer 4 and the contact angle θ between an aluminum-based molten metal 5 and the protecting Ni-plated layer 4. This was found by a meniscograph method, and the aluminum-based molten metal 5 is formed of an aluminum alloy corresponding to JIS AC3A, wherein the temperature of the aluminum-based molten metal 5 was set at 650° C., and the temperature of the cast iron material portion 3 preheated was set at 650° C. It can be seen from FIG. 3 that if the thickness a of the protecting Ni-plated layer 4 is smaller than 0.8 μm, the contact angle θ is increased, resulting in a degraded wettability of the protecting Ni-plated layer 4 and the aluminum-based molten metal 5. The same is true of the protecting plated layer formed of Cu, Fe or the like.

3. Third Step

The cast iron material portion 3, as thus treated, is placed in a basket coated with ceramics, until the third step to a fifth step are completed.

The cast iron material portion 3 is preheated within a furnace having a non-oxidizing/reducing atmosphere, and the oxide in the surface of the protecting plated layer is reduced. A gas mixture of nitrogen gas and hydrogen gas is used as a reducing gas, and has a volume ratio of $N_2$:$H_2$ equal to (25 to 50):(75 to 50). A reducing temperature d is in a range of 650° C.≦d≦800° C., and a retention time e for the reduction is in a range of 10 sec≦e≦600 sec.

4. Fourth Step

In a reducing atmosphere, the temperature of the cast iron material portion 3 is regulated to a temperature f of the aluminum-based molten metal used for a molten aluminum-based plating treatment, i.e., to a range of 620° C.≦f≦720° C., and the cast iron material portion 3 is immersed into an aluminum-based molten metal. The immersion time c is in a range of 1 sec≦c≦10 sec, as described above. Thus, the protecting plated layer disappears by a diffusion phenomenon, and an aluminum-based alloy plated layer is formed on the surface of the cast iron material portion 3. Then, the cast iron material portion and thus the basket is picked up out of the aluminum-based molten metal and then rotated, thereby discharging the surplus aluminum-based molten metal to regulate the thickness of the aluminum-based plating layer. Even during this time, an intermetallic compound on the surface of the cast iron material portion 3 continues to grow and hence, it is desirable that the regulation of the thickness is performed within a short time, e.g., within 5 seconds.

In the composition of the aluminum-based molten metal used for the molten aluminum-based plating treatment, Si is a requisite chemical constituent, and the content thereof is set in a range of 7% by weight≦Si≦15% by weight. If the Si content is set in such a range, the growth of the intermetallic compound can be suppressed, and the melting point of the molten metal can be lowered. A chemical constituent such as Mg, Cu, Mn, Ti, Be and like may be properly added to suppress the oxidation and the growth of the intermetallic compound and to improve the characteristic, e.g., the toughness and the like.

5. Fifth Step

The cast iron material portion 3 is quenched in an atmosphere of an inert gas such as nitrogen gas or the like. More specifically, while the temperature of the cast iron material portion 3 is being dropped from a temperature at the time when it has been removed from the aluminum-based molten metal to a temperature lower than 350° C. by spraying the inert gas onto the cast iron material portion 3, the cooling speed b of the cast iron material portion 3 is set in a range of b≧5° C./sec. Then, the cast iron material portion 3 is removed from the basket.

If the temperature of the cast iron material portion 3 is maintained at about 500° C., the growth of the intermetallic compound layer is promoted, and if the temperature of the cast iron material portion 3 is maintained at about 350° C., the oxidation of the aluminum-based alloy plated layer advances. However, such disadvantages are avoided by employing the above-described quenching means. In place of the inert gas, a reducing gas similar to those described above may be used.

6. Sixth Step

The cast iron material portion 3 is preheated to 200° C. to 350° C. by an induction heating or the like and placed into a metal mold for casting, whereby the cast iron material portion 3 is incorporated into the aluminum-based body 2 by casting. Any of various conventional processes may be used as a casting process. Especially, a normal die-cast process using an aluminum alloy can be used, because it is easy to place the cast iron material portion into the metal mold.

Particular examples of the invention and the prior art for comparison will be described below.

1. First Step

A Ni-resist cast iron material portion 3 having a width of 50 mm, a length of 80 mm and a thickness of 5 mm was subjected sequentially to an oxide film removing treatment, a degreasing treatment which involved immersing the cast iron material portion 3 into acetone for 24 hours, and an acid cleaning treatment which involved immersing the cast iron material portion 3 into 20% hydrochloric acid for 2 minutes.

2. Second Step

The Ni-resist cast iron material portion 3 was subjected to an Ni electroplating treatment to form a protecting Ni-plated layer having a thickness a of 1.5 $\mu$m.

3. Third Step

The Ni-resist cast iron material portion 3 was accommodated in a basket and placed into an non-oxidizing/reducing atmosphere furnace, where the Ni-resist cast iron material portion 3 was preheated up to 700° C. at a heating rate g of 5° C./sec for about 135 seconds. Then, the oxide on the surface of the protecting Ni-plated layer was reduced at a reducing temperature d of 700° C. for a retention time e of 10 seconds. A gas mixture of nitrogen gas and hydrogen gas with a volume ratio of $N_2$:$H_2$ equal to 50:50 was used as a reducing gas.

4. Fourth Step

In a reducing atmosphere using a reducing gas similar to the reducing gas used at the third step, the temperature of the Ni-resist cast iron material portion 3 was dropped to about 650° C. at a cooling rate h of 5° C./sec for about 10 seconds.

Then, the Ni-resist cast iron material portion 3 was immersed into the molten aluminum alloy maintained at the same temperature, i.e., at 650° C. and subjected to a molten aluminum alloy plating treatment, whereby an aluminum alloy-plated layer was formed on the surface of the Ni-resist cast iron material portion 3. This aluminum alloy is one corresponding to JIS AC3A containing 12% by weight of Si. The immersion time c was set to at 2 seconds.

Thereafter, the basket was pulled up out of the molten aluminum alloy and rotated at about 300 rpm for 2 seconds to discharge the surplus molten aluminum alloy.

5. Fifth Step

Nitrogen gas was sprayed onto the Ni-resist cast iron material portion 3, thereby cooling the Ni-resist cast iron material portion 3 down to 350° C. at cooling rate b of 20° C./sec for 15 seconds, and then, the Ni-resist cast iron material portion 3 was removed from the basket.

6. Sixth Step

The Ni-resist cast iron material portion 3 was preheated to 250° C. by induction heating and then placed into a metal mold. Thereafter, a gravity casting was carried out using a molten aluminum alloy, whereby the Ni-resist cast iron material portion 3 was incorporated into the aluminum-based body 2 by the casting to provide an example of an aluminum-based composite member 1 shown in FIGS. 1 and 2. An aluminum alloy corresponding to JIS AC8A was used as the casting aluminum alloy.

The same operations were repeated except that the immersion time c at the fourth step and/or the cooling rate b at the fifth step were changed, thereby producing a plurality of aluminum-based composite members 1.

As the prior art example, the first step was carried out and then, the molten aluminum alloy plating treatment (fourth step) was carried out using the same molten aluminum alloy as that described above in the atmosphere. Thereafter, the fifth and sixth steps were carried out to produce a plurality of aluminum-based composite members.

Each of the aluminum-based composite members was measured for the thickness k of an intermetallic compound layer existing between the Ni-resist cast iron material portion 3 and the aluminum-based body 2 and the bond strength m between the aluminum-based body 2 and the Ni-resist cast iron material portion 3.

Figure 4:
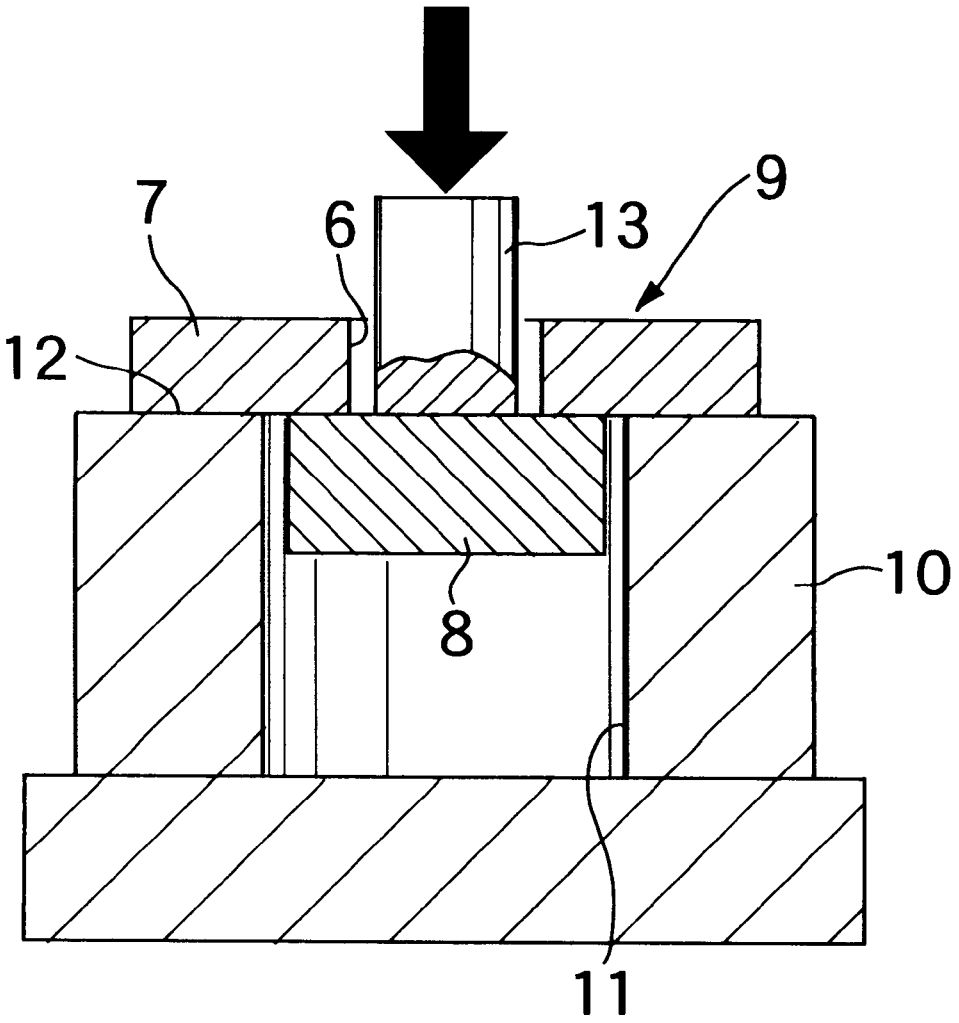
FIG. 4 is a view for explaining a bond strength testing method.

In measuring the bond strength m, a test piece 9 was first made which was comprised of a Ni-resist cast iron portion 7 having a through-hole 6 at a central portion thereof and an aluminum-based body 8 bonded to the Ni-resist cast iron portion 7 to cover one of openings of the through-hole 6, as shown in FIG. 4. Then, the test piece 9 was placed, with the aluminum-based body 8 located on the underside, into an upward opening bore 11 in a supporting block 10, so that the peripheral portion of the Ni-resist cast iron portion 7 was placed onto the annular upper end face of the supporting block 10. Thereafter, a pin 13 was placed into the through-hole 6 in the Ni-resist cast iron portion 7, and a load was applied to the aluminum-based body 8 through the pin 13. A load at the time of breaking of the aluminum-based body 8 from the Ni-resist cast iron portion 7 was found, and this was determined as a bond strength m.

Shown in Tables 1 to 4 are the immersion time c, the cooling rate b, the thickness k of the intermetallic compound layer and the bond strength for examples $A_1$ to $A_9$ of the aluminum-based composite members 1 produced according to the embodiment of the present invention and examples $B_1$ to $B_{15}$ of aluminum-based composite members produced according to the prior art.

TABLE 1

| EXAMPLE | $A_1$ | $A_2$ | $A_3$ | $B_1$ | $B_2$ | $B_3$ |
|---|---|---|---|---|---|---|
| APPLICATION | EMBODIMENT | | | PRIOR ART | | |
| IMMERSION TIME c (seconds) | 2 | 5 | 10 | 15 | 30 | 60 |
| COOLING RATE b (° C./sec) | 20 | 20 | 20 | 20 | 20 | 20 |
| THICKNESS k of INTERMETALLIC COMPOUND LAYER (μm) | 3 | 3.5 | 4 | 6 | 12.5 | 13 |
| BOND STRENGTH m (MPa) | 31.5 | 29 | 26 | 14 | 10 | 9.5 |

TABLE 2

| EXAMPLE | $A_4$ | $A_5$ | $A_6$ | $B_4$ | $B_5$ | $B_6$ |
|---|---|---|---|---|---|---|
| APPLICATION | EMBODIMENT | | | PRIOR ART | | |
| IMMERSION TIME c (seconds) | 2 | 5 | 10 | 15 | 30 | 60 |
| COOLING RATE b (° C./sec) | 12 | 12 | 12 | 12 | 12 | 12 |
| THICKNESS k of INTERMETALLIC COMPOUND LAYER (μm) | 4 | 5 | 6 | 10 | 14 | 17 |
| BOND STRENGTH m (MPa) | 24.5 | 22.5 | 19.5 | 11.5 | 8 | 6 |

TABLE 3

| EXAMPLE | $A_7$ | $A_8$ | $A_9$ | $B_7$ | $B_8$ | $B_9$ |
|---|---|---|---|---|---|---|
| APPLICATION | EMBODIMENT | | | PRIOR ART | | |
| IMMERSION TIME c (seconds) | 2 | 5 | 10 | 15 | 30 | 60 |
| COOLING RATE b (° C./sec) | 5 | 5 | 5 | 5 | 5 | 5 |
| THICKNESS k of INTERMETALLIC COMPOUND LAYER (μm) | 7.5 | 8.5 | 10 | 15 | 16.5 | 23 |
| BOND STRENGTH m (MPa) | 18 | 17.5 | 16 | 8 | 6.5 | 4.5 |

TABLE 4

| EXAMPLE | $B_{10}$ | $B_{11}$ | $B_{12}$ | $B_{13}$ | $B_{14}$ | $B_{15}$ |
|---|---|---|---|---|---|---|
| APPLICATION | PRIOR ART | | | | | |
| IMMERSION TIME c (seconds) | 2 | 5 | 10 | 15 | 30 | 60 |
| COOLING RATE b (° C./sec) | 2 | 2 | 2 | 2 | 2 | 2 |
| THICKNESS k of INTERMETALLIC COMPOUND LAYER (μm) | 15 | 17 | 18 | 21.5 | 22 | 25 |
| BOND STRENGTH m (MPa) | 8 | 7.5 | 6 | 5 | 3 | 2.5 |

Figure 5:
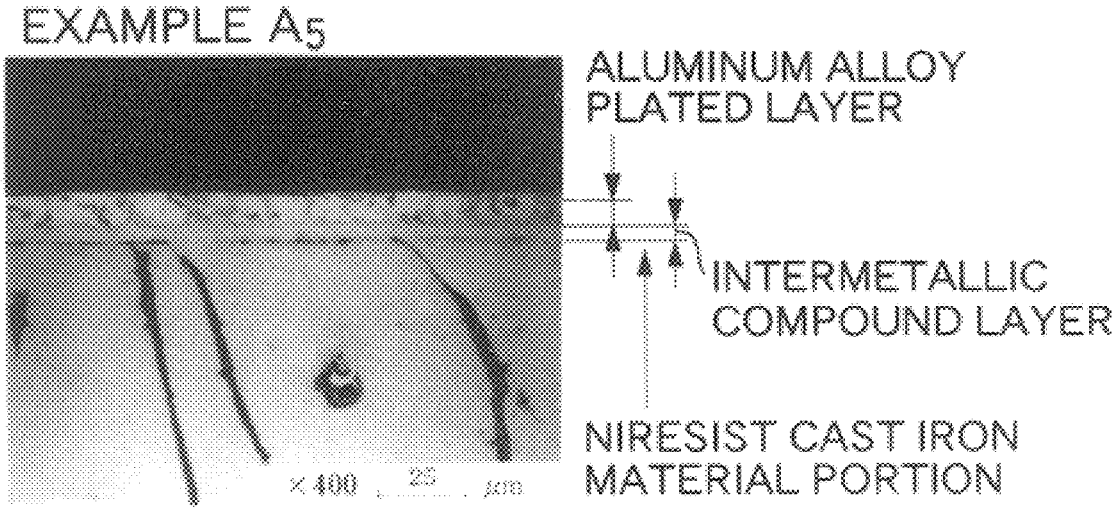
FIG. 5 is a photomicrograph showing the metallographic structure of an aluminum alloy plated layer portion in an intermediate product for an example $A_5$.
Figure 6:
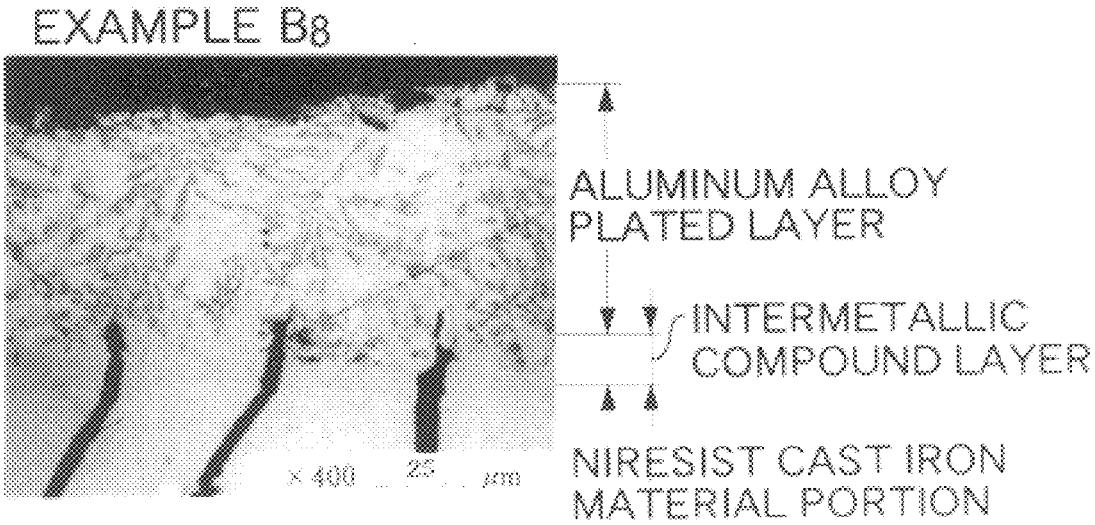
FIG. 6 is a photomicrograph showing the metallographic structure of an aluminum alloy plated layer portion in an intermediate product for an example $B_8$.

FIG. 5 is a photomicrograph showing the metallographic structure of an aluminum alloy-plated layer portion in that intermediate product for the example As, which was formed through the fourth step, and FIG. 6 is a similar photomicrograph of example $B_8$. For the intermediate product for the example $A_5$ shown in FIG. 5, the thickness k of the intermetallic compound layer is smaller, and flake-shaped graphite does not penetrate the intermetallic compound layer. For the intermediate product of example $B_8$ shown in FIG. 6, the thickness k of the intermetallic compound layer is about 3.3 times as large as that of the example $A_5$ and moreover, flake-shaped graphite penetrates the intermetallic compound layer. This penetration state is liable to appear when the immersion time c in the molten aluminum alloy plating treatment is equal to or longer than 15 seconds.

Figure 7:
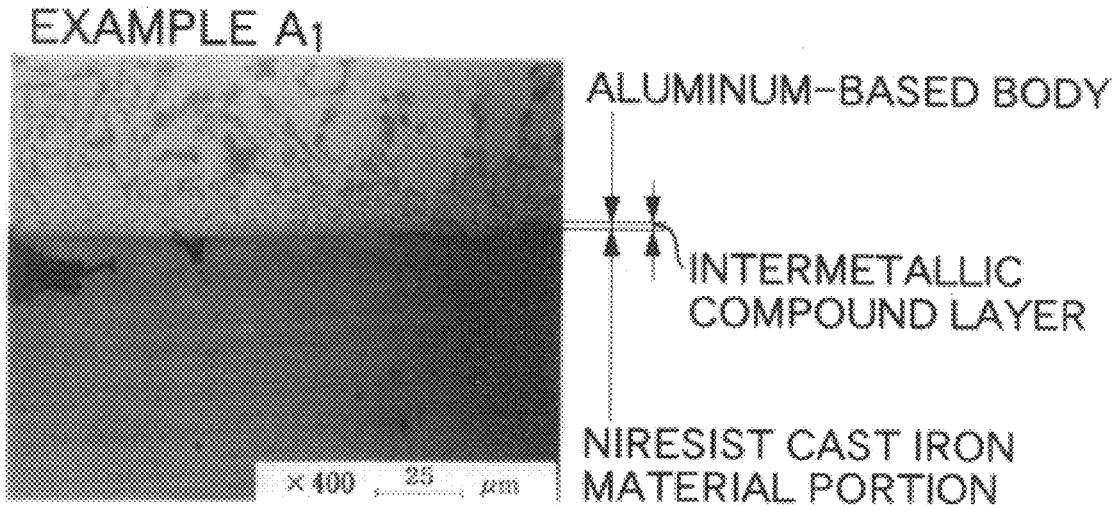
FIG. 7 is a photomicrograph showing the metallographic structure of a bond area in an example $A_1$.
Figure 8:
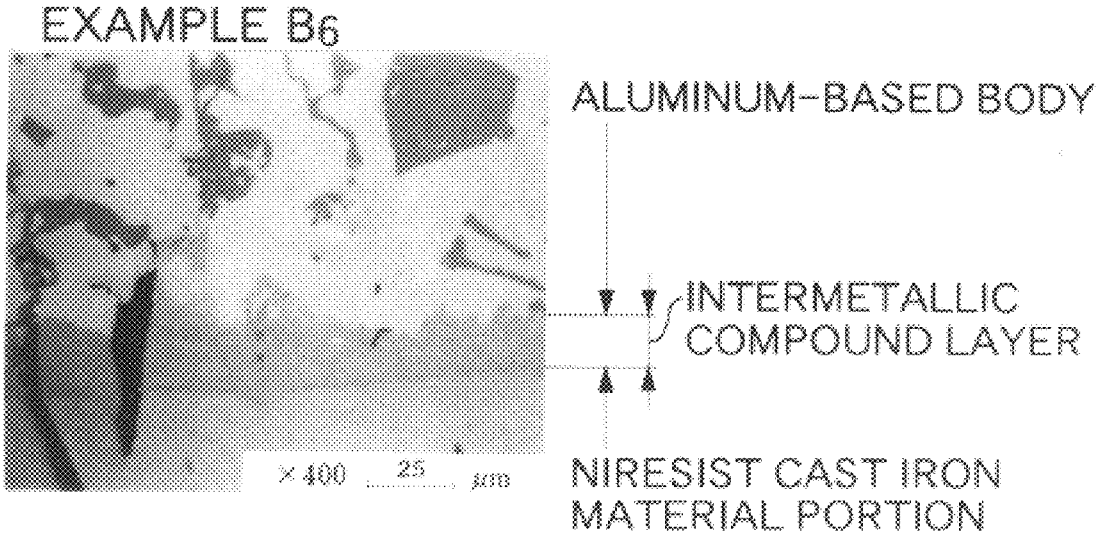
FIG. 8 is a photomicrograph showing the metallographic structure of a bond area in an example $B_6$.

FIG. 7 is a photomicrograph showing the metallographic structure of a bond area in the example $A_1$ of a composite member, and FIG. 8 is a similar photomicrograph showing the metallographic structure of a bond area in the example $B_6$. In the example $A_1$, flake-shaped graphite does not penetrate the intermetallic compound layer, but in the example $B_6$, flake-shaped graphite penetrates the intermetallic compound layer.

Figure 9:
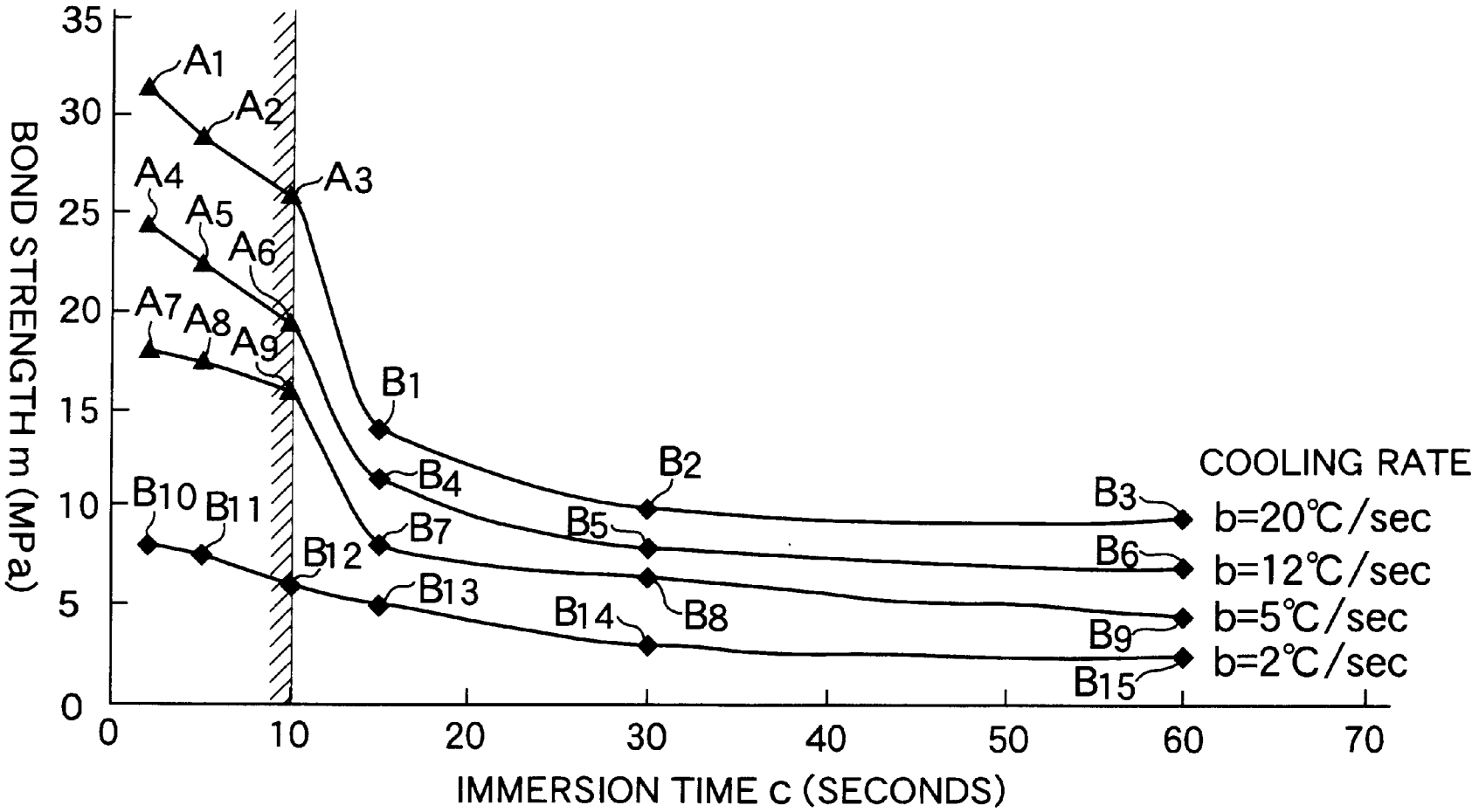
FIG. 9 is a graph showing the relationship between the immersion time c and the bond strength m.

FIG. 9 is a graph based on Tables 1 to 4 by cooling rates b and showing the relationship between the immersion time c and the bond strength m. As is apparent from FIG. 9, if the immersion time c is set in a range of $c \leqq 10$ seconds and the cooling rate b is set in a range of $b \geqq 5°$ C./sec as in the examples $A_1$ to $A_9$, the bond strength m can be increased. The cooling rate b is preferably in a range of $b \geqq 12°$ C./sec.

Figure 10:
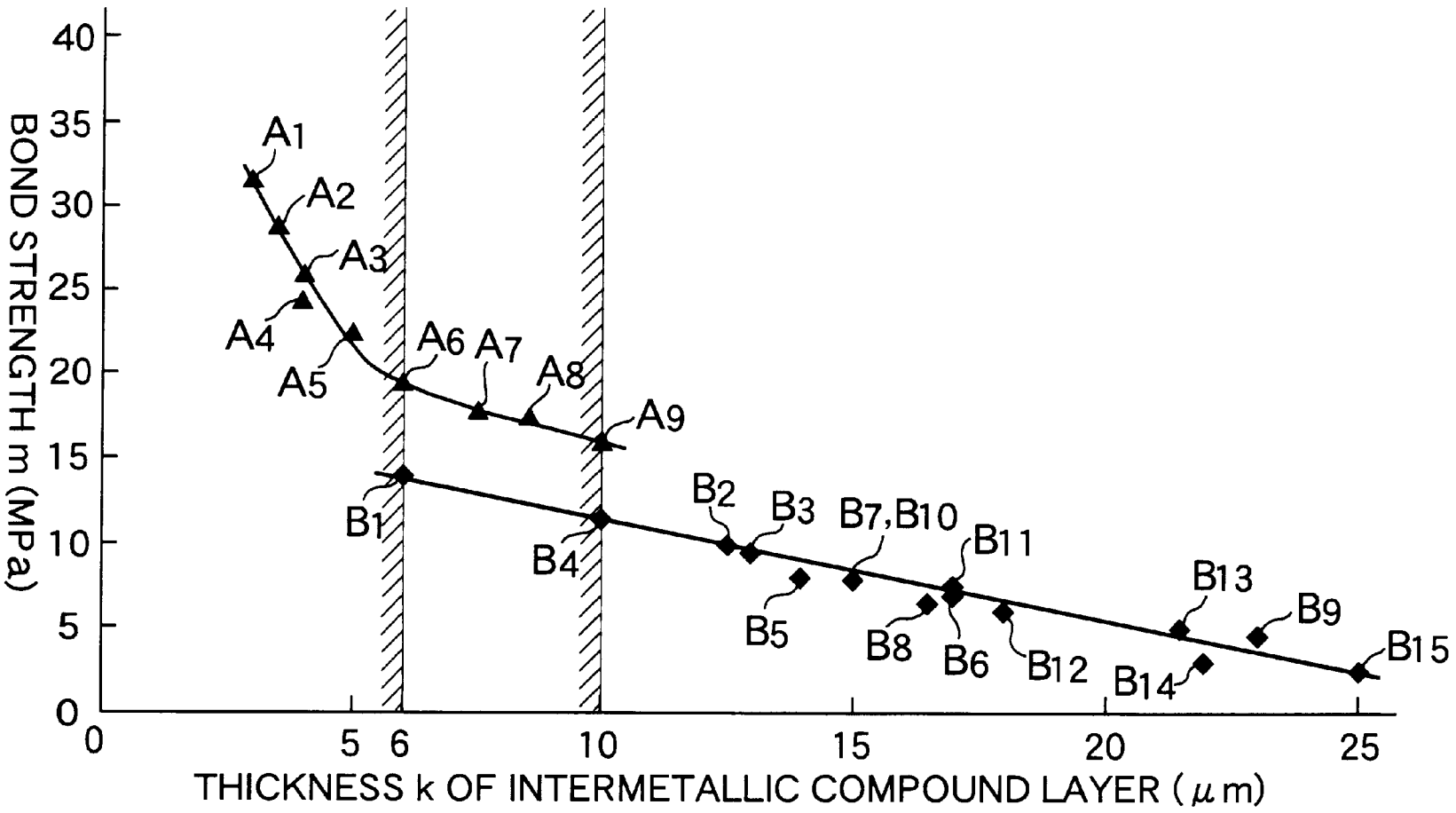
FIG. 10 is a graph showing the relationship between the thickness k of an intermetallic compound layer and the bond strength m.

FIG. 10 is a graph based on Tables 1 to 4 and showing the relationship between the thickness k of the intermetallic compound layer and the bond strength m. As is apparent from FIG. 10, the bond strength m can be increased to a range of $m \geqq 16$ MPa by setting the thickness k of the intermetallic compound layer in a range of $k \leqq 10$ μm as in the examples $A_1$ to $A_9$. The thickness k is preferably in a range of $k \leqq 6$ μm.

In each of the examples $B_1$ to $B_9$ and $B_{13}$ to $B_{15}$, the bond strength m is lower than that in each of the examples $A_1$ to $A_9$, because the flake-shaped graphite penetrates the intermetallic compound layer. In the case of the examples $B_{10}$ to $B_{12}$, the flake-shaped graphite penetrating state does not appear, because of the short immersion time, but the intermetallic compound layer is increased, because of the lower cooling rate b, and due to this, the bond strength is lower.

Figure 11:
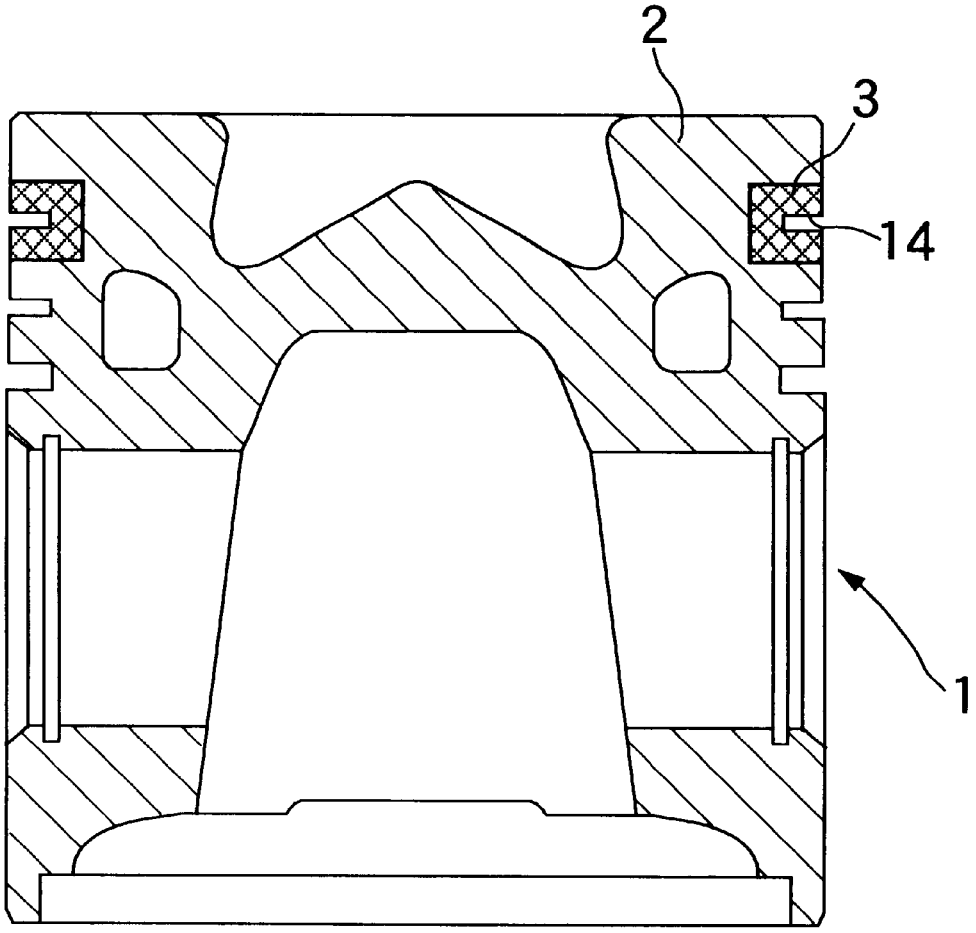
FIG. 11 is a vertical sectional front view of a piston for a diesel engine.

FIG. 11 shows a piston 1 for a diesel engine as an aluminum-based composite member produced according to the present invention. The piston 1 is comprised of a piston body 2 formed of an aluminum alloy, e.g., JIS AC8A, and an annular Ni-resist cast iron material portion 3 incorporated into the piston body 1 by casting to form a first pressure ring groove 14. In this case, the bond strength between the piston body 2 and the niresist cast iron material portion 3 is higher and hence, the piston 1 can sufficiently withstand a thermal treatment with a higher thermal shock such as T6 and T7 intended to increase the strength of the piston 1. Thus, it is possible to produce a piston which is thin, light, and strong and enables an increase in output power of the diesel engine.

According to the present invention, it is possible to produce an aluminum-based composite member having a higher bond strength between an aluminum-based body and a cast iron material portion by employing the measures as described above.

What is claimed:

1. A process for producing an aluminum-based composite member comprised of an aluminum-based body and a cast iron material portion incorporated into the aluminum-based body by casting, said process comprising a first step of removing an oxide film on a surface of said cast iron material portion and activating such surface, a second step of forming a protecting plated-layer having a thickness a in a range of $0.8\mu \leqq a \leqq 5$ μm on the surface of said cast iron material portion, a third step of preheating said cast iron material portion in a reducing atmosphere and reducing an oxide on a surface of said protecting plated-layer, a fourth step of vanishing the protecting plated-layer by a diffusing phenomenon and forming an aluminum-based alloy plated layer on the surface of said cast iron material portion by immersing said cast iron material portion into a molten aluminum-based alloy for a period of ≦10 seconds, a fifth step of quenching said cast iron material portion in an atmosphere of one of an inert gas and a reducing gas by lowering a temperature of said cast iron material portion to less than 350° C. from a temperature at the time when said cast iron material portion has been removed from said molten aluminum-based alloy at a cooling speed b of said cast iron material portion equal to or larder than 5° C./second, and a sixth step of incorporating said cast iron material portion into said aluminum-based body by casting.

2. A process for producing an aluminum-based composite member according to claim 1, wherein said molten aluminum-based alloy in said fourth step includes 7% by weight≦Si≦15% by weight.

3. A process for producing an aluminum-based composite member according to claim 1, wherein said aluminum-based alloy plated layer formed in said fourth step is an intermetallic compound layer of a thickness k in a range of ≦10 μm between said aluminum-based body and said cast iron material portion of the aluminum-based composite member.

4. A process for producing an aluminum-based composite member according to claim 1, wherein said aluminum-based alloy plated layer formed in said fourth step is an intermetallic compound layer of a thickness of approximately 6 μm between said aluminum-based body and said cast iron material portion of the aluminum-based composite member.

5. A process for producing an aluminum-based composite member according to claim 1, wherein said protecting plated-layer formed in said second step is of at least one of Ni, Cu and Fe.

6. A process for producing an aluminum-based composite member according to claim 1, wherein said protecting plated-layer formed in said second step forms an oxide of at least one of Ni, Cu and Fe that is reduced in said third step.

7. A process for producing an aluminum-based composite member according to claim 1, wherein said fourth step includes removing the cast iron material portion from the molten aluminum-based alloy and subjecting the cast iron material portion to a physical movement within 5 seconds for causing surplus molten aluminum-based alloy to be discharge from the surface.

8. A process for producing an aluminum-based composite member according to claim 7, wherein the cast iron material portion is supported in a basket which is spun as the physical movement for discharging the surplus molten aluminum-based alloy.

9. A process for producing an aluminum-based composite member according to claim 1, wherein said molten aluminum-based alloy in said fourth step includes at least one of Mg, Cu. Mn, Ti and Be.

10. A process for producing an aluminum-based composite member according to claim 2, wherein said molten aluminum-based alloy in said fourth step includes at least one of Mg, Cu, Mn, Ti and Be.

11. A process for producing an aluminum-based composite member according to claim 1, wherein said aluminum-based alloy plated layer formed in said fourth step is an intermetallic compound layer formed at a rate and of an effective thickness and composition for minimizing the formation of flake-shaped graphite in the layer.

12. A process for producing an aluminum-based composite member according to claim 1, wherein said second step of forming a protecting plated-layer is performed immediately following said first step for minimizing the formation of oxides on the cast iron material portion.

* * * * *